US008897660B2

(12) United States Patent
Furukawa

(10) Patent No.: US 8,897,660 B2
(45) Date of Patent: Nov. 25, 2014

(54) IMAGE FORMING APPARATUS AND METHOD

(71) Applicant: Kunio Furukawa, Toyokawa (JP)

(72) Inventor: Kunio Furukawa, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 168 days.

(21) Appl. No.: 13/711,811

(22) Filed: Dec. 12, 2012

(65) Prior Publication Data

US 2013/0156453 A1 Jun. 20, 2013

(30) Foreign Application Priority Data

Dec. 16, 2011 (JP) ..... 2011-276204

(51) Int. Cl.
*G03G 15/08* (2006.01)

(52) U.S. Cl.
CPC ..... *G03G 15/0818* (2013.01)
USPC ..... 399/53; 399/236; 399/286; 358/3.2

(58) Field of Classification Search
CPC ..... G03G 15/0818
USPC ..... 399/53, 236, 286; 358/3.2
See application file for complete search history.

(56) References Cited

U.S. PATENT DOCUMENTS

| | | | | |
|---|---|---|---|---|
| 6,133,927 | A | 10/2000 | Arai et al. | |
| 7,565,099 | B2 | 7/2009 | Yamada et al. | |
| 2005/0117927 | A1 | 6/2005 | Tanaka et al. | |
| 2007/0177908 | A1 * | 8/2007 | Aruga et al. | 399/286 |

FOREIGN PATENT DOCUMENTS

| | | | |
|---|---|---|---|
| JP | 01-202768 | A | 8/1989 |
| JP | 04-088368 | A | 3/1992 |
| JP | 04-088374 | A | 3/1992 |
| JP | 08-149325 | A | 6/1996 |
| JP | 10-023280 | A | 1/1998 |
| JP | 11-198451 | A | 7/1999 |
| JP | 2005-115154 | A | 4/2005 |
| JP | 2005-167550 | A | 6/2005 |
| JP | 2007-192899 | A | 8/2007 |
| JP | 2009-128775 | A | 6/2009 |
| JP | 2010-048858 | A | 3/2010 |
| JP | 2011-100145 | A | 5/2011 |

OTHER PUBLICATIONS

Office Action (Decision to Grant Patent) issued on Jan. 28, 2014, by the Japan Patent Office in corresponding Japanese Patent Application No. 2011-276204, and an English Translation of the Office Action. (6 pages).

* cited by examiner

*Primary Examiner* — David Gray
*Assistant Examiner* — Michael Harrison
(74) *Attorney, Agent, or Firm* — Buchanan Ingersoll & Rooney PC

(57) ABSTRACT

In an image forming apparatus, a control circuit rotationally drives a development roller at a predetermined rotation speed during a development process, in which the development roller has depression portions and land portions on a circumferential surface. The depression portions and the land portions are oblique grooves in the surface. While the development roller is rotationally driven, the control circuit controls the predetermined rotation speed such that a crossing angle approximates 90°. The crossing angle is formed by a screen line in the electrostatic latent image on the circumferential surface of the latent image support and an area where the land portion of the development roller substantially passes over the circumferential surface of the latent image support.

9 Claims, 11 Drawing Sheets

IMAGE FORMING APPARATUS AND METHOD

This application is based on Japanese Patent Application No. 2011-276204 filed on Dec. 16, 2011, the content of which is incorporated herein by reference.

BACKGROUND OF THE INVENTION

1. Field of the Invention

The present invention relates to an image forming apparatus and method for developing an electrostatic latent image formed on the surface of a photoreceptor using a developer carried by a developer support with a grooved surface.

2. Description of Related Art

In the image forming apparatus that employs electrophotography, an exposure device emits an optical beam modulated with image data to the surface of a charged photoreceptor. As a result, an electrostatic latent image is formed on the surface of the photoreceptor. Moreover, a development device holds a binary developer composed of a magnetic carrier and a non-magnetic toner, and a development roller mounted therein carries the binary developer to a position to face the photoreceptor. At this time, a developing bias voltage is applied to the development roller. As a result, the electrostatic latent image is developed by the binary developer, resulting in a visually recognizable toner image formed on the surface of the photoreceptor. Such a toner image is formed for each of the four colors yellow, magenta, cyan, and black, for example. The toner images of these colors are transferred and overlaid on one another as a composite image on an intermediate transfer belt.

Incidentally, printing paper, which is a typical example of a recording medium, is introduced to a nip (i.e., secondary transfer portion) between the intermediate transfer belt and a secondary transfer roller. The composite image on the intermediate transfer belt is subjected to secondary transfer onto the introduced printing paper by means of an electric field from the secondary transfer roller. Thereafter, the printing paper with the composite image transferred thereon is introduced to a fusing unit, and the fusing unit heats and fixes the toner. Subsequently, a print is ejected onto an output tray.

The force to carry the binary developer is obtained from the frictional resistance of the development roller surface. To maintain this carrying force, it is desirable for the frictional resistance not to be degraded over long-term use. However, in the development process, the development roller and the developer repeatedly collide with each other. Accordingly, in the case where aluminum, which is liable to deteriorate, is used as the material of the development roller, simply roughening the development roller surface by blasting or suchlike does not keep the frictional resistance from degrading over time, thereby failing to provide a stable force to carry the binary developer. In view of this problem, there has been proposed an approach in which the surface of a development roller is grooved with a predetermined pitch (e.g., see Japanese Patent Laid-Open Publication No. 2011-100145). For example, forming grooves with a pitch of about 1 millimeter [mm] can reduce degradation of the frictional resistance over time, making it possible to maintain the force to carry the binary developer for a longer period of time.

However, the amount of binary developer supported on the grooved surface of the development roller is lesser on ungrooved portions (land portions) than in grooves (depression portions), resulting in a problem with unstable density of an image formed on a print. Uneven density of an image is very noticeable particularly in highlighted areas, which are highly visible portions of the image.

SUMMARY OF THE INVENTION

An image forming apparatus according to a first embodiment of the present invention includes: a latent image support; an optical scanning system configured to form an electrostatic latent image at a predetermined screen angle on a circumferential surface of the latent image support; a container configured to hold a binary developer; a development roller disposed so as to face the latent image support and form a development area in between, and configured to carry the binary developer from the container to the development area; and a control circuit configured to rotationally drive the development roller at a predetermined rotation speed during a development process, in which the development roller, has depression portions and land portions on a circumferential surface, the depression portions and the land portions forming oblique grooves in the surface, and while the development roller is rotationally driven, the control circuit is configured to control the predetermined rotation speed such that a crossing angle approximates 90°, the crossing angle being formed by a screen line in the electrostatic latent image on the circumferential surface of the latent image support and an area where the land portion of the development roller substantially passes over the circumferential surface of the latent image support.

An image forming apparatus according to a second embodiment of the present invention includes: a latent image support; an optical scanning system configured to form an electrostatic latent image on a circumferential surface of the latent image support, at a first screen angle in a first print mode, and at a second screen angle different from the first screen angle in a second print mode; a container configured to hold a binary developer; a development roller disposed so as to face the latent image support and form a development area in between, and configured to carry the binary developer from the container to the development area; and a control circuit configured to rotationally drive the development roller at a first rotation speed during a development process, in which the development roller has depression portions and land portions on a circumferential surface, the depression portions and the land portions forming oblique grooves in the surface, and in the second print mode, the control circuit is configured to rotationally drive the development roller at a second rotation speed different from the first rotation speed, such that a crossing angle approximates 90°, the crossing angle being formed by a screen line in the electrostatic latent image on the circumferential surface of the latent image support and an area where the land portion of the development roller substantially passes over the circumferential surface of the latent image support.

An image forming apparatus according to a third embodiment of the present invention includes: a latent image support; an optical scanning system configured to form an electrostatic latent image at a predetermined screen angle on a circumferential surface of the latent image support; a container configured to hold a binary developer; a development roller disposed so as to face the latent image support and form a development area in between, and configured to carry the binary developer from the container to the development area; and a control circuit configured to rotationally drive the development roller during a development process, in which the development roller has depression portions and land portions on a circumferential surface, the depression portions and the land portions being created by forming grooves in the surface at a predetermined angle of inclination, and the angle of inclination is decided such that a crossing angle approximates 90° while the development roller is rotationally driven, the crossing angle being formed by a screen line in the electrostatic latent image on the circumferential surface of the latent image support and an area where the land portion of the development roller substantially passes over the circumferential surface of the latent image support.

An image forming method according to a fourth embodiment of the present invention for use in an image forming apparatus including a latent image support, an optical scanning system configured to form an electrostatic latent image at a predetermined screen angle on a circumferential surface of the latent image support, a container configured to hold a binary developer, and a development roller that is disposed so as to face the latent image support and form a development area in between, and configured to carry the binary developer from the container to the development area, the method including the steps of: determining a current print mode from among a plurality of print modes; setting a screen angle for the determined print mode, the screen angle varying among the print modes, and rotationally driving the development roller at a rotation speed for the screen angle being set, the rotation speed varying among screen angles to be set, in which the development roller has depression portions and land portions on a circumferential surface, the depression portions and the land portions being created by forming grooves in the surface at a predetermined angle of inclination, and the rotation speed of the development roller is decided for each print mode such that a crossing angle approximates 90°, the crossing angle being formed by a screen line in the electrostatic latent image on the circumferential surface of the latent image support and an area where the land portion of the development roller substantially passes over the circumferential surface of the latent image support.

BRIEF DESCRIPTION OF THE DRAWINGS

in FIG. 7A, a photoreceptor drum and a development roller are equal in circumference speed, and in FIG. 7B, the rotation speed of the development roller is increased to n-fold.

DETAILED DESCRIPTION OF THE PREFERRED EMBODIMENTS

Figure 1:
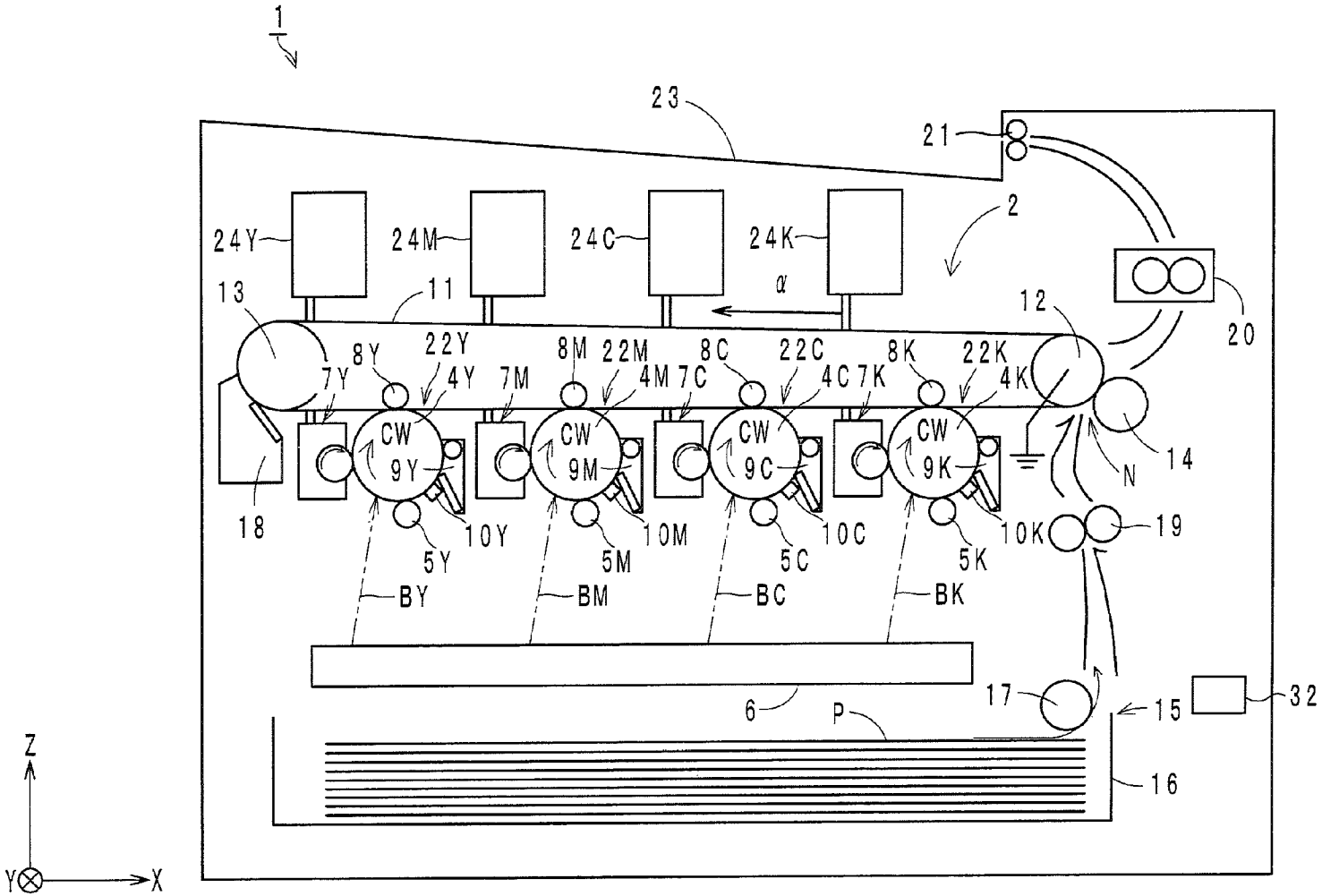
FIG. 1 is a schematic view illustrating the internal configuration of image forming apparatuses according to embodiments.

Hereinafter, an image forming apparatus according to each embodiment of the present invention will be described with reference to the drawings. In several figures, the X, Y, and Z-axes represent the right-left (horizontal), depth (front-rear), and height (vertical) directions, respectively, of the image forming apparatus. In addition, Y, M, C, and K added to reference numerals refer to yellow, magenta, cyan, and black. For example, photoreceptor drum $\mathbf{10}_Y$ is a photoreceptor drum 10 for yellow.

General Configuration of Image Forming Apparatus

In FIG. 1, the image forming apparatus 1 is typically a tandem electrophotographic printer, copier, or fax machine or a combination thereof. The image forming apparatus 1 uses photoreceptor drums 4 for yellow, cyan, magenta, and black to form toner images of these colors substantially at the same time, and thereafter transfers the toner images onto paper P. For such a printing process, the image forming apparatus 1 generally includes a supply unit 15, a pair of timing rollers 19, a process unit 2, a fusing device 20, a pair of ejection rollers 21, and an output tray 23.

The supply unit 15 includes a paper tray 16 and a feed roller 17. The paper tray 16 allows unprinted sheets of paper P to be placed therein. The feed roller 17 picks up the sheets of paper P one by one from the paper tray 16, and feeds the sheets to the timing rollers 19.

Paper P from the feed roller 17 hits the contact (nip) between the timing rollers 19. The timing rollers 19 pass paper P therebetween with timing adjusted for accurate secondary transfer onto paper P, and feed paper P to nip N to be described later.

The process unit 2 includes an optical scanning system 6, a transfer portion 8 for each color, an intermediate transfer belt 11, a drive roller 12, a driven roller 13, a secondary transfer roller 14, a cleaning device 18, an imaging portion 22 for each color, and a toner bottle 24 for each color. In addition, each imaging portion 22 has a photoreceptor drum 4, a charger 5, a development device 7, a cleaner 9, and an eraser 10, for its corresponding color.

For each color, drive force from an unillustrated motor rotates the photoreceptor drum 4 clockwise as indicated by arrow CW at a predetermined constant rotation speed. The photoreceptor drum 4 is a typical example of the latent image support that holds an electrostatic latent image on its circumferential surface.

For each color, the charger 5 negatively charges the circumferential surface of the photoreceptor drum 4 for that color.

The optical scanning system 6 receives image data. The image data is data representing an image to be printed on paper P, and is generated by a scanner or a personal computer (neither is shown). The optical scanning system 6 generates an optical beam B for each color, on the basis of the received image data, and scans the optical beam B in a main scanning direction on the circumferential surface of the photoreceptor drum 4 for that color, which is being rotated. The potential on the circumferential surface approximates 0V in portions irradiated with the beam B. In this manner, the photoreceptor drum 4 has an electrostatic latent image for its corresponding color formed on the circumferential surface.

Figure 2:
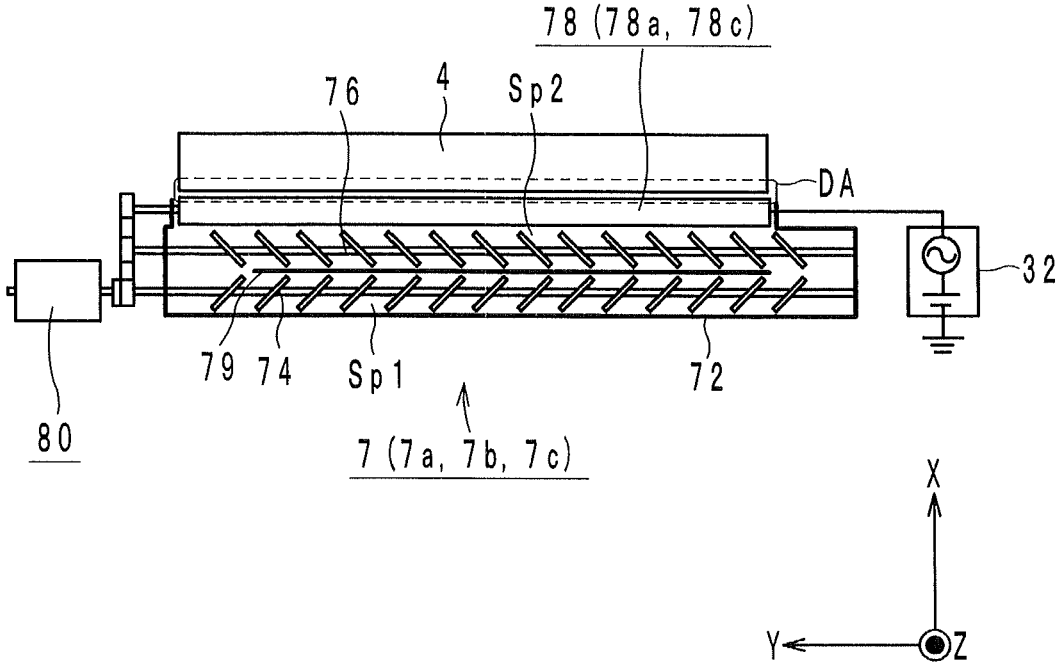
FIG. 2 is a schematic view illustrating a general configuration of a development device of FIG. 1.

Next, the development device 7 in FIGS. 1 and 2 will be described for features in common among embodiments. Note that the respective features of the embodiments will be described in detail later. For each color, the development device 7 contains a binary developer composed of a non-magnetic toner of that corresponding color and a magnetic carrier. The development device 7 uses the toner of the color to develop an electrostatic latent image on the circumferential surface of the photoreceptor drum 4 for the color, thereby forming a toner image on the circumferential surface. For this development process, the development device 7 generally includes a casing 72, an agitation screw 74, a supply screw 76, a development roller 78, a partition 79, and a motor 80, as shown in FIG. 2.

Note that in FIG. 2, reference characters 7*a*, 7*b*, and 7*c* denote development devices in first, second, and third embodiments, respectively, to be described later. Similarly, reference characters 78*a* and 78*c* denote development rollers in the first and third embodiments, respectively.

The casing 72 is a typical example of the container for the binary developer, and has the agitation screw 74, the supply screw 76, and the development roller 78 housed therein. In addition, the casing 72 has created therein agitation space Sp1 and supply space Sp2 capable of containing a binary developer for the corresponding color. These spaces Sp1 and Sp2 extend in depth direction Y, and are separated by the partition 79 so as to be adjacent to each other in horizontal direction X. Note that the partition 79 has openings formed at opposite ends in depth direction Y, and spaces Sp1 and Sp2 are in communication with each other at the ends.

Both of the screws 74 and 76 are rotated by drive force from the motor 80. As a result, the agitation screw 74 stirs the binary developer within the agitation space $Sp_1$, thereby negatively/positively charging the toner in the binary developer. Moreover, the rotation of the screws 74 and 76 carries the binary developer, for example, from the back to the front in depth direction Y within agitation space Sp1 and in the opposite direction within supply space Sp2. Thus, the binary developer is circulated within a space created by spaces Sp1 and Sp2 and the partition 79.

Note that when a density sensor (not shown) detects the amount of toner remaining in the casing 72 to be running low, the toner bottle 24 for the corresponding color supplies the casing 72 with additional toner. Moreover, when the toner bottle 24 is emptied, the empty toner bottle 24 is manually replaced with a new toner bottle 24.

The development roller 78 has a sleeve-like shape extending in depth direction Y, and is disposed in the casing 72 so as to be opposed to the supply screw 76. Moreover, the development roller 78 is disposed so as to face the photoreceptor drum 4 from an opening provided in the casing 72. In addition, the development roller 78 includes a magnet to be secured on the casing 72, and attraction of the magnet draws the magnetic carrier, along with the non-magnetic toner, from supply space $Sp_2$, thereby supporting the binary developer. Furthermore, the development roller 78 is rotated along the circumferential surface of the magnet by drive force from the motor 80, thereby carrying the binary developer being supported to development area DA indicated by a dotted frame in FIG. 2.

In development area DA, the toner in the binary developer is applied to the photoreceptor drum 4, thereby developing an electrostatic latent image. Here, a developing bias from a biasing circuit 32 causes the potential on the outer circumferential surface of the development roller 78 to be lower than the potential (approximately 0V) in portions irradiated with the beam B on the circumferential surface of the photoreceptor drum 4, and higher in other portions. Moreover, the non-magnetic toner supported on the development roller 78 is negatively charged, and therefore adheres to the portions irradiated with the beam B on the photoreceptor drum 4. As a result, a negatively charged toner image is formed on the circumferential surface of the photoreceptor drum 4.

The intermediate transfer belt 11 is stretched between the drive roller 12 and the driven roller 13, and toner images formed on the photoreceptor drums 4 are subjected to primary transfer onto the belt 11. For each color, the transfer portion 8 is disposed so as to be opposed to its corresponding photoreceptor drum 4 with respect to the intermediate transfer belt 11, and upon application of a primary transfer voltage, a toner image of the color is subjected to primary transfer from the photoreceptor drum 4 to the intermediate transfer belt 11.

After the primary transfer, the cleaner 9 recovers the toner remaining on the circumferential surface of the photoreceptor drum 4, and the eraser 10 removes charge from the circumferential surface.

The drive roller 12 is rotated by drive force from a motor (not shown) for the intermediate transfer belt, thereby driving the intermediate transfer belt 11 in the direction of arrow a. As a result, the intermediate transfer belt 11 carries the primary-transfer toner image to the secondary transfer roller 14.

The secondary transfer roller 14 is disposed in contact with the intermediate transfer belt 11, and is opposed to the drive roller 12 with respect to the intermediate transfer belt 11. Accordingly, there is nip N formed between the intermediate transfer belt 11 and the secondary transfer roller 14. In addition, a positive bias voltage is applied to the secondary transfer roller 14. As a result, the secondary transfer roller 14 subjects the toner images supported on the intermediate transfer belt 11 to secondary transfer onto paper P passing through nip N. The cleaning device 18 has a blade in contact with the intermediate transfer belt 11, and removes the toner remaining on the intermediate transfer belt 11 after the secondary transfer of the toner images.

Paper P with the secondary-transfer toner images is introduced to the fusing device 20. The fusing device 20 heats and presses paper P, thereby fixing the toner images onto paper P. Paper P subjected to the fixing process is ejected through the ejection rollers 21 and placed onto the output tray 23 as print P.

First Embodiment

Hereinafter, the development device 7*a* provided in the image forming apparatus 1 in the first embodiment will be described in detail.

Configuration of Development Roller

Figure 3:
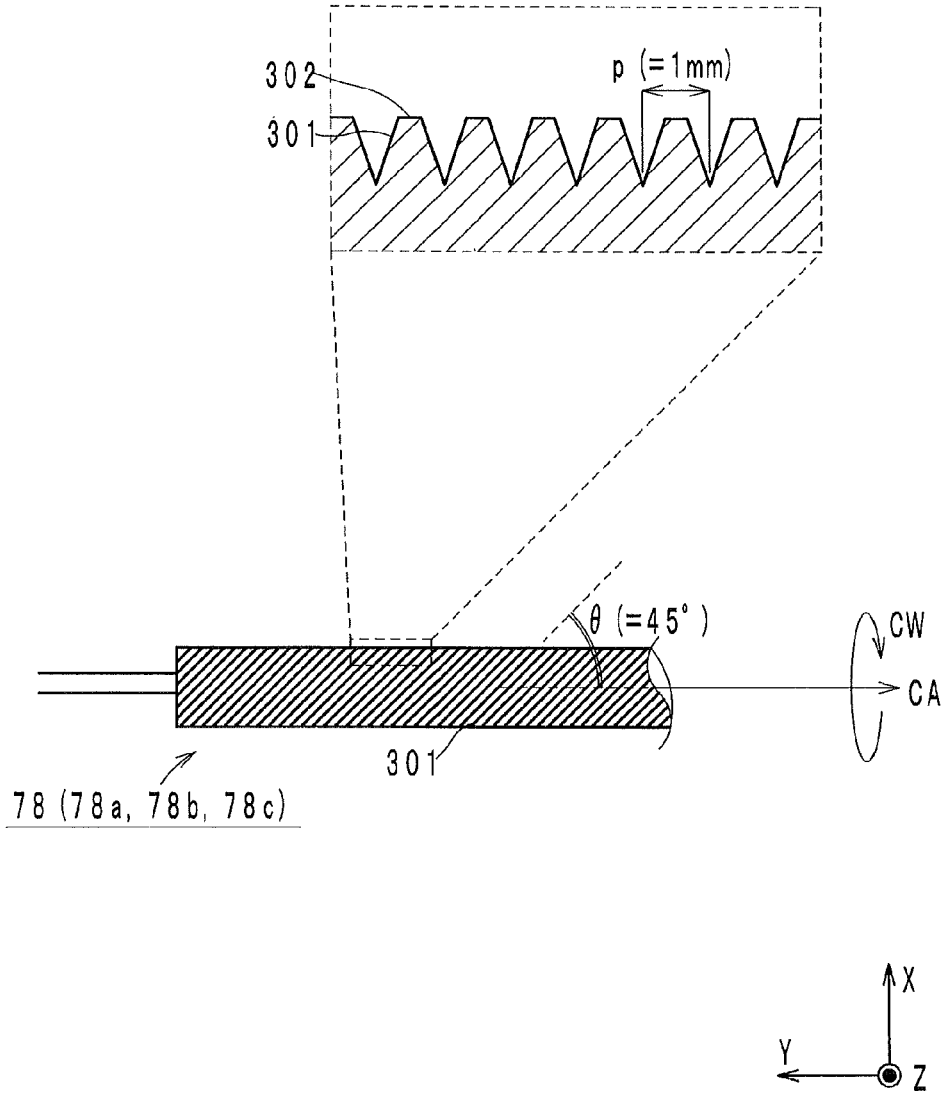
FIG. 3 is a schematic view illustrating grooves (depression portions) and land portions of a development roller according to a first embodiment.

In FIG. 3, there are spiral grooves (depression portions) 301 formed in the outer circumferential surface of the development roller 78*a* by etching, for example. The grooves 301 are formed with a predetermined pitch, obliquely with respect to central axis CA parallel to depth direction Y or with respect to rotational direction CW mentioned above. In the present embodiment, the angle θ of the grooves is set at 45° considering the force to carry the binary developer. Note that the angle θ is the same as the angle of land portions 302 to central axis CA or rotational direction CW.

Furthermore, to inhibit a reduction in the carrying force over long-term use, groove pitch p is set to about 1 mm in the direction of central axis CA. As a result, low-cost aluminum or aluminum alloy can be used to realize the development roller 78 that can endure long-term use. Note that portions of the outer circumferential surface of the development roller 78 other than the grooves (depression portions) 301 will be referred to below as land portions 302.

Relationship between Screen Lines and Land Portions

Figure 4:
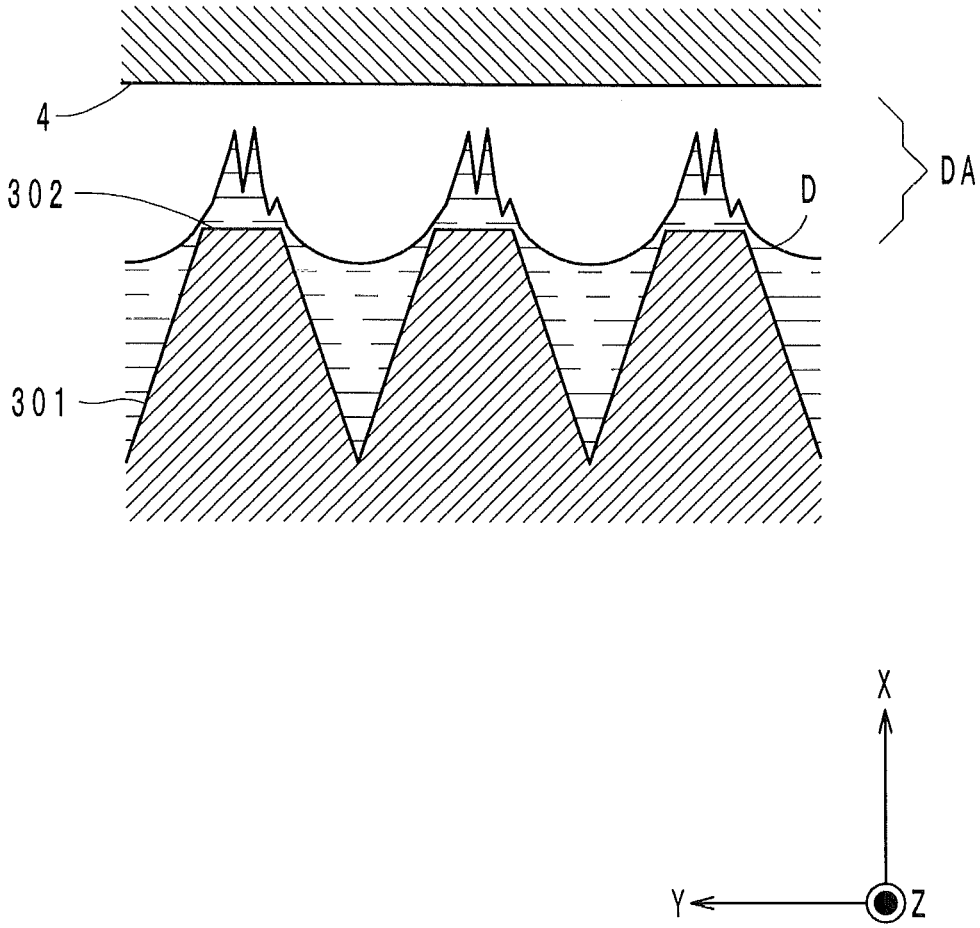
FIG. 4 is a schematic view showing the amount of binary developer supported by the grooves (depression portions) and the land portions of FIG. 3.

FIG. 4 is referenced now. In FIG. 4, binary developer D is shown as being supported on the outer circumferential surface of the development roller 78*a*. Specifically, the grooves (depression portions) 301 in the outer circumferential surface hold a significant amount of binary developer D, but little binary developer D is held on the land portions 302. Therefore, when the development roller 78*a* faces the photoreceptor drum 4 in development area DA, there are variations in height among spikes of the binary developer D in the grooves (depression portions) 301 and on the land portions 302. As a result, image degradation occurs due to a reduction in toner density caused by the land portions 302 holding a small amount of binary developer D, and also due to a toner image on the circumferential surface of the photoreceptor drum 4 being disturbed by spikes with various heights. Such image degradation is not noticeable in a solid-color image, but in the case of a half-tone image, image degradation is particularly noticeable due to pattern disruption. Moreover, such image degradation is least noticeable when screen lines in an electrostatic latent image on the circumferential surface of the photoreceptor drum 4 have an angle of 90° to the land portions 302 on the outer circumferential surface of the development roller 78*a*, and image degradation becomes more noticeable as the angle decreases.

Figure 5:
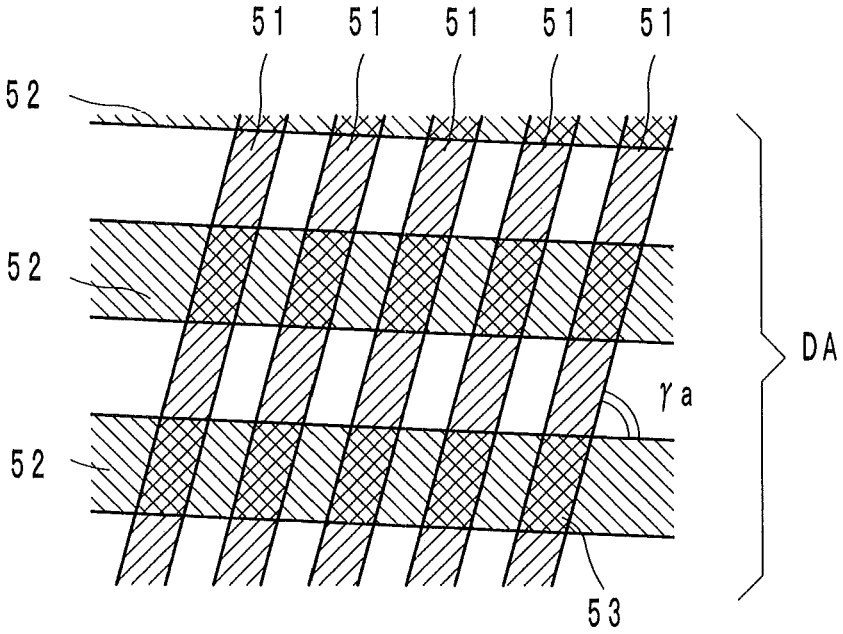
FIG. 5 is a schematic view showing the relationship between screen lines in an electrostatic latent image and land portions of a development roller.

For example, FIG. 5 shows screen lines 51 with a screen angle of 70° in an electrostatic latent image. Here, the screen angle is a counterclockwise angle from the three o'clock position. In addition, FIG. 5 shows regions (referred to below as linear regions) 52 along which land portions 302 of the development roller 78*a* substantially pass on the circumferential surface of the photoreceptor drum 4, with development area DA viewed from the direction of the X-axis. The toner density is unstable in crossing regions 53 where the linear regions 52 and the screen lines 51 cross. Note that in FIG. 5, reference numeral 53 is assigned to only one crossing region for convenience sake, but in actuality, there are a number of crossing regions created in accordance with the intervals at which the land portions 302 are formed and the number of screen lines in the electrostatic latent image.

The area of the crossing region 53 decreases as crossing angle $\gamma_a$ of the screen line 51 and the linear region 52 relatively approximates 90°. In addition, the closer crossing angle $\gamma_a$ is to 90°, the shorter the interval between adjacent crossing regions 53 becomes. Accordingly, when crossing angle $\gamma_a$ is 90°, users conceivably perceive the least uneven density.

Figure 6:
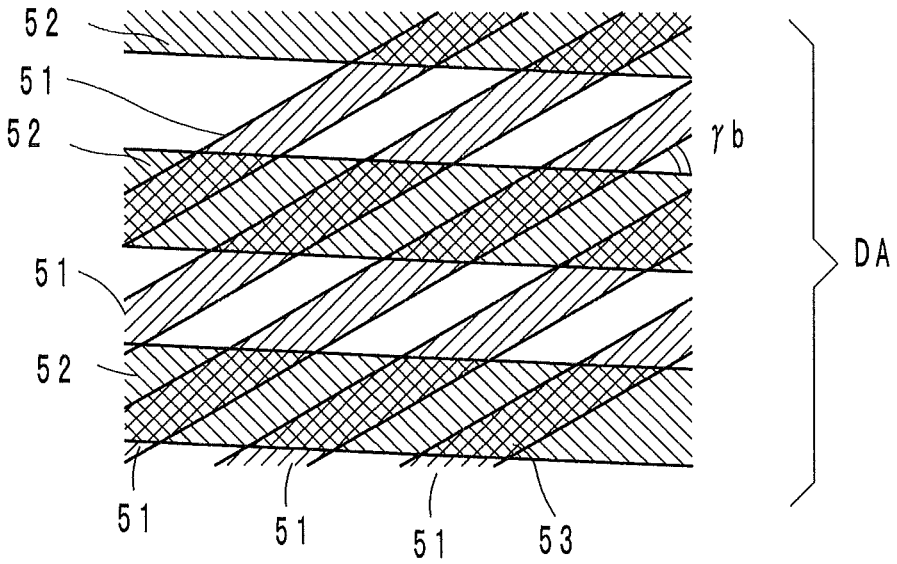
FIG. 6 is a schematic view showing the area of a crossing region with a small crossing angle.

However, the screen angle varies in accordance with print modes (print qualities) and colors. For example, in the case where crossing angle $\gamma_b$ is small and other conditions are the same as in the example of FIG. 5, the area of the crossing region 53 is larger, as shown in FIG. 6. When the area of the crossing region 53 is large as above, it is highly probable that users perceive uneven density.

Relationship between Rotation Speed of Development Roller and Angle of Land

Figure 7A:
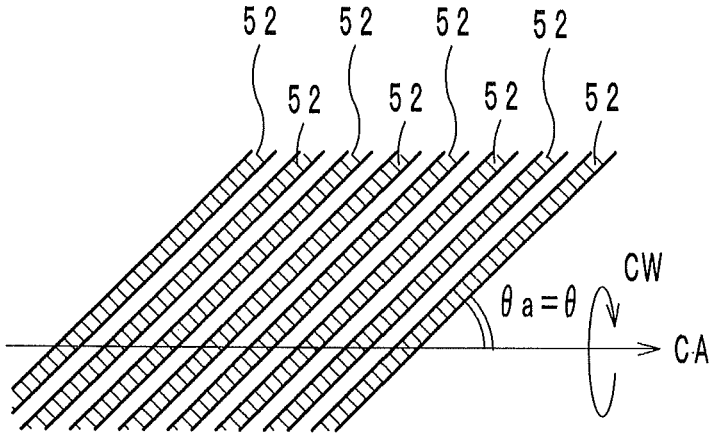
FIGS. 7A and 7B are schematic views showing angles of linear regions.
Figure 7B:
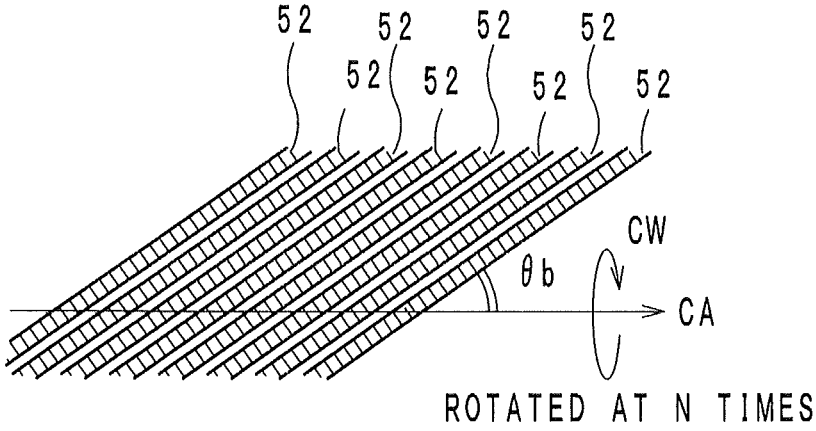

In FIG. 2, if the photoreceptor drum 4 and the development roller 78*a* are equal in circumference speed (the travel speed of a dot on the circumferential surface per unit time), the angle of the linear region 52 to central axis CA of the development roller 78*a* (referred to below as the angle $\theta_a$ of the linear region 52) is the same as the angle θ of the land 302 (in the present embodiment, 45°), as shown in FIG. 7A. Here, as shown in FIG. 7B, the development roller 78*a* is rotated at n times the rotation speed in the case of FIG. 7A. In this case, the speed at which the land 302 travels in the direction of central axis CA is increased to substantially n-fold, and therefore the tangent of the angle $\theta_b$ of the linear region 52 (tan $\theta_b$) is 1/n times the tangent of the angle $\theta_a$. From the above, it is appreciated that the angle of the linear region 52 can be controlled to be a desired value by appropriately setting the rotation speed of the development roller 78.

Regarding Control Block

Figure 8:
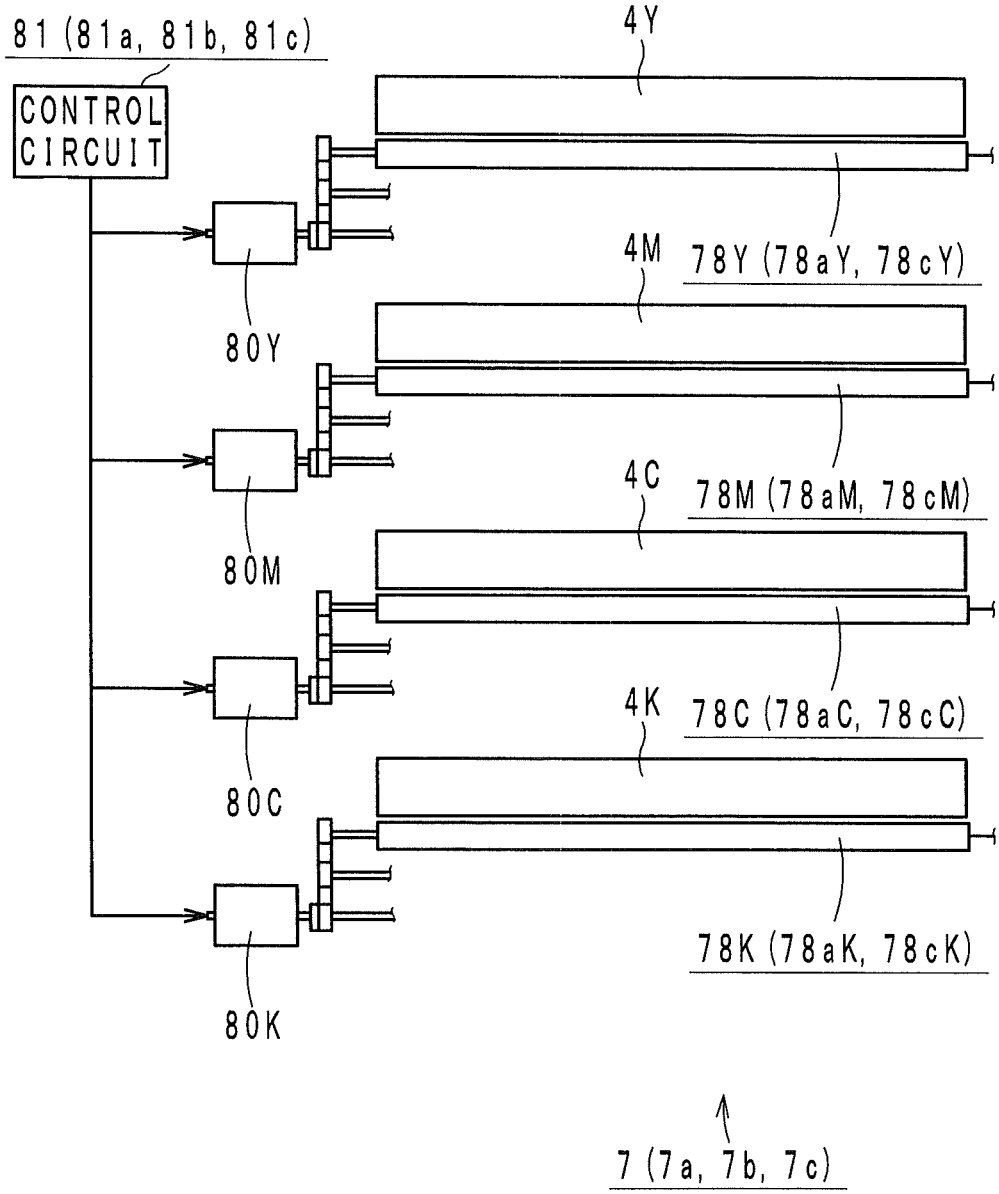
FIG. 8 is a schematic view illustrating a control block for the development devices according to the embodiments.

In the present embodiment, the rotation speed of the development roller 78*a* is appropriately set for each color, thereby inhibiting uneven density from being perceived by users. FIG. 8 shows an exemplary configuration for that purpose in which development roller $\mathbf{78}a_Y$ is connected to motor $\mathbf{80}_Y$ via a gear or suchlike, and development rollers $\mathbf{78}a_M$, $\mathbf{78}a_C$, and $\mathbf{78}a_K$ are similarly connected to motors $\mathbf{80}_M$, $\mathbf{80}_C$, and $\mathbf{80}_K$. A control circuit 81*a* is composed of a processor, main memory, etc., and operates in accordance with the procedure of FIG. 9, thereby controlling the rotation speeds of development rollers $\mathbf{78}a_Y$, $\mathbf{78}a_M$, $\mathbf{78}a_C$, and $\mathbf{78}a_K$.

Note that in the example shown in FIG. 8, each development roller 78*a* is connected to one motor 80. However, this is not restrictive, and the image forming apparatus 1 may be configured such that a single motor 80 distributes drive force to the development rollers 78*a* via gears.

Furthermore, FIG. 8 will be referenced later as well for the second and third embodiments. For this reason, FIG. 8 indicates reference characters for the second and third embodiments as well. Reference characters 7*b* and 7*c* are intended for the development devices according to the second and third embodiments. Reference character 78*c* is intended for the development rollers in the third embodiment. Moreover, reference characters 81*b* and 81*c* are intended for the control circuits according to the second and third embodiments.

Regarding Specific Examples of Parameters

In the case where the print mode (print quality) is graphics mode, the screen angles for yellow, magenta, cyan, and black are appropriately set to their respective different values as exemplified below.

screen angle (Y): 115° (=180°−65°)
screen angle (M): 125° (=180°−55°)
screen angle (C): 135° (=180°−45°)
screen angle (K): 145° (=180°−35°)

Furthermore, the outer diameter ϕ1 and the rotation speed n1 of the photoreceptor drum 4 are as exemplified below.

outer diameter ϕ1: 30 mm
rotation speed n1: 4 rps

Furthermore, the outer diameter ϕ2 and the groove angle θ of the development roller 78*a* are as exemplified below.

outer diameter ϕ2: 15 mm
groove angle θ: 45°

In the above example, when the rotation speed n2 of the development roller 78*a* is set at 16 rps, the photoreceptor drum 4 and the development roller 78*a* are equal in circumference speed, and the angle $\theta_a$ of the linear region 52 is 45°.

As described earlier, it is most preferable that the crossing angle γ of the screen line 51 and the linear region 52 be 90°. Accordingly, to set the crossing angle γ at 90° for yellow, magenta, cyan, and black, the angle $\theta_b$ of the linear region 52 is set for each color as follows.

angle $\theta_{bY}$ of linear region 52: 25° tan $\theta_{bY}$=0.47 angle $\theta_{bM}$ of linear region 52: 35° tan $\theta_{bM}$=0.70
angle $\theta_{bC}$ of linear region 52: 45° tan $\theta_{bC}$=1.00
angle $\theta_{bK}$ of linear region 52: 55° tan $\theta_{bK}$=1.43

Accordingly, for each color, the setting value n3 for the rotation speed of the development roller 78*a* is as follows.

setting value n$3_Y$: 34.3 rps
setting value n$3_M$: 22.9 rps
setting value n$3_C$: 16.0 rps
setting value n$3_K$: 11.2 rps The screen angle and the setting value n3 are prestored for each color in the control circuit 81*a*.

Regarding Printing Procedure

Figure 9:
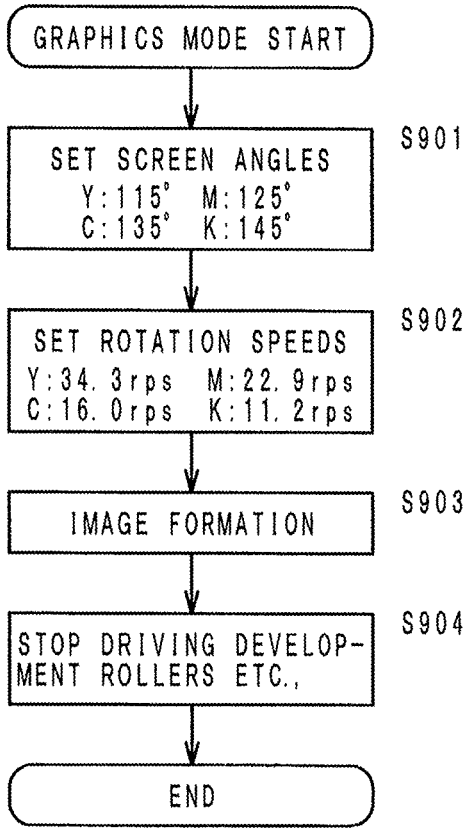
FIG. 9 is a flowchart showing the procedure for a process by a control circuit according to the first embodiment.

In FIG. 9, the control circuit 81*a* starts a printing process upon reception of an instruction for copying from an operating panel of the image forming apparatus 1 or a print command from a personal computer. In the present embodiment, graphics mode is set as a typical example of the print mode (print quality). The print mode is decided on the basis of, for example, a result of analysis on a scanned image, the user's selection, or image attribute information specified by the print command.

In graphics mode, the control circuit 81*a* sets screen angle (Y) at 115°, screen angle (M) at 125°, screen angle (C) at 135°, and screen angle (K) at 145° (step S901).

Furthermore, the control circuit 81*a* transmits control signals to motors 80$_Y$, 80$_M$, 80$_C$, and 80$_K$ in order to drive development roller 78*a*$_Y$ at 34.3 rps, development roller 78*a*$_M$ at 22.9 rps, development roller 78*a*$_C$ at 16.0 rps, and development roller 78*a*$_K$ at 11.2 rps (step S902).

In addition to the driving of the development rollers 78, for example, the control circuit 81*a* performs driving of the photoreceptor drum 4 for each color, thereby controlling image formation (step S903). Upon completion of image formation, the control circuit 81*a* stops driving the development rollers 78 and so on (step S904), thereby ending the printing operation.

As described above, in the present embodiment, the development roller 78*a* has the spiral grooves 301 formed in the outer circumferential surface. In this case, there is a difference in the amount of supported binary developer D between the depression portions 301 and the land portions 302, resulting in uneven density. However, in the present embodiment, for each color, the motor 80 is controlled such that the crossing angle γ of the screen line 51 and the linear region 52 is 90°. As a result, for each color, the area of the crossing region 53 for the screen line 51 and the linear region 52 can be relatively small, and the interval between adjacent crossing regions 53 can be relatively small. Thus, it is possible to allow users to perceive less uneven density upon viewing of a print by the image forming apparatus 1.

Note that in the above embodiment, for each color, the motor 80 is controlled such that the crossing angle γ of the screen line 51 and the linear region 52 is 90°. However, this is not restrictive, and a similar effect to that achieved in the above embodiment can be achieved by controlling the motor 80 for each color such that the crossing angle γ approximates 90°.

Furthermore, in the case where the motor 80 is controlled for each color such that the crossing angle γ approximates 90°, it is apparent that a similar effect can be achieved as well by setting the rotation speed such that the crossing angle γ for the color targeted for control is closer to 90° for the screen angle being set for that color than for a screen angle for another color being set temporarily for the color targeted for control.

Second Embodiment

In FIG. 8, the development device 7*b* differs in configuration from the development device 7*a* in that a control circuit 81*b* is provided in place of the control circuit 81*a*. There is no other configurational difference between the development devices 7*a* and 7*b*. Therefore, components of the development device 7*b* that correspond to those of the development device 7*a* are denoted by the same reference characters, and any descriptions thereof will be omitted.

Figure 10:
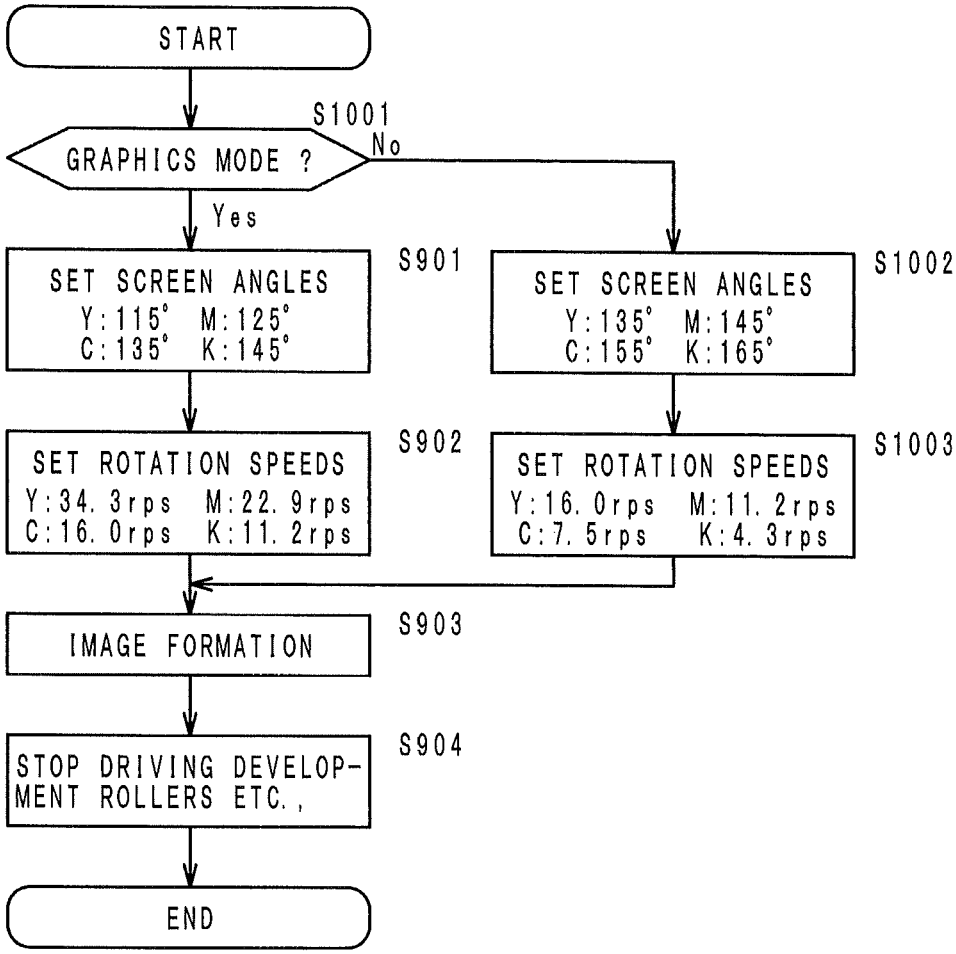
FIG. 10 is a flowchart showing the procedure for a process by a control circuit according to a second embodiment.

The control circuit 81*b* is composed of a processor, main memory, etc., and operates in accordance with the procedure shown in FIG. 10, thereby appropriately controlling the rotation speeds of development rollers 78*a*$_Y$, 78*a*$_M$, 78*a*$_C$, and 78*a*$_K$ in accordance with the print mode (print quality). In the present embodiment, the printing process is performed in graphics mode described above and also in text mode.

Regarding Specific Examples of Parameters

First, in text mode, the outer diameter ϕ1, the rotation speed n1, the outer diameter ϕ2, the groove angle θ, and the rotation speed n2 are the same as those described in the first embodiment, and therefore any descriptions thereof will be omitted.

Moreover, in text mode, the screen angles for yellow, magenta, cyan, and black have their respective different values as exemplified below.

screen angle (Y): 135° (=180°−45°)
screen angle (M): 145° (=180°−35°)
screen angle (C): 155° (=180°−25°)
screen angle (K): 165° (=180°−15°)

To set the crossing angle γ at 90° for yellow, magenta, cyan, and black, the angle $\theta_b$ of the linear region 52 is set for each color as follows.

angle $\theta_{bY}$ of linear region 52: 45° tan $\theta_{bY}$=1.00
angle $\theta_{bM}$ of linear region 52: 55° tan $\theta_{bM}$=1.43
angle $\theta_{bC}$ of linear region 52: 65° tan $\theta_{bC}$=2.14
angle $\theta_{bK}$ of linear region 52: 75° tan $\theta_{bK}$=3.73

Accordingly, in text mode, for each color, the setting value n3 for the rotation speed of the development roller 78*a* is as follows.

setting value n$3_Y$: 16.0 rps
setting value n$3_M$: 11.2 rps
setting value n$3_C$: 7.5 rps
setting value n$3_K$: 4.3 rps The screen angle and the setting value n3 are prestored for each color in the control circuit 81*b*.

Regarding Printing Procedure

FIG. 10 is a flowchart showing the procedure for the printing process by the control circuit 81*b*. This flowchart differs from the flowchart of FIG. 9 in that steps S1001 to S1003 are further included. There is no other difference between the flowcharts. Therefore, steps in FIG. 10 that correspond to those in FIG. 9 are denoted by the same step numbers, and any descriptions thereof will be omitted.

The control circuit 81*b* starts a printing process upon reception of an instruction for copying from an operating panel of the image forming apparatus 1 or a print command from a personal computer. The control circuit 81*b* first determines whether or not to set the print mode (print quality) to graphics mode (S1001). As in the first embodiment, the print mode (print quality) is decided on the basis of, for example, a result of image analysis, the user's selection, or image attribute information specified by the print command.

When the determination of S1001 is Yes, the control circuit 81*b* performs S901 and S902 (described earlier) intended for graphics mode, which is a typical example of a first print mode.

On the other hand, when the determination of S1001 is No, for each color, the control circuit 81*b* sets a screen angle for text mode, which is a typical example of a second print mode, thereby adjusting the rotation speed of the development roller. Specifically, the control circuit 81*b* sets screen angle (Y) at 135°, screen angle (M) at 145°, screen angle (C) at 155°, and screen angle (K) at 165° (step S1002).

Furthermore, the control circuit 81*b* transmits control signals to motors $\mathbf{80}_Y$, $\mathbf{80}_M$, $\mathbf{80}_C$, and $\mathbf{80}_K$ in order to drive development roller $\mathbf{78}a_Y$ at 16.0 rps, development roller $\mathbf{78}a_M$ at 11.2 rps, development roller $\mathbf{78}a_C$ at 7.5 rps, and development roller $\mathbf{78}a_K$ at 4.3 rps (step S1003).

After step S902 or S1003, the control circuit 81*b* performs the processing from S903 onward described in the first embodiment.

In the present embodiment, the screen angle and the rotation speed of the development roller in text mode are changed for each color to optimal values different from those in graphics mode. In this manner, the present embodiment allows users to perceive less uneven density upon viewing of a print by the image forming apparatus 1 even in the case where the print mode (print quality) is text mode.

Note that in the present embodiment also, a similar effect to that achieved in the earlier embodiment can be achieved by controlling the motor 80 for each color such that the crossing angle γ approximates 90°.

Furthermore, in the case where the motor 80 is controlled for each color such that the crossing angle γ approximates 90°, it is apparent that a similar effect can be achieved as well by setting the rotation speed such that the crossing angle γ for the print mode targeted for control is closer to 90° for the screen angle being set for that print mode than for a screen angle for another print mode being set temporarily for the print mode targeted for control.

Third Embodiment

In FIG. 8, the development device 7*c* differs in configuration from the development device 7*a* in that a control circuit 81*c* is provided in place of the control circuit 81*a* and a development roller 78*c* is provided for each color in place of the development roller 78*a*. There is no other configurational difference between the development devices 7*a* and 7*c*. Therefore, components of the development device 7*c* that correspond to those of the development device 7*a* are denoted by the same reference characters, and any descriptions thereof will be omitted.

Figure 11:
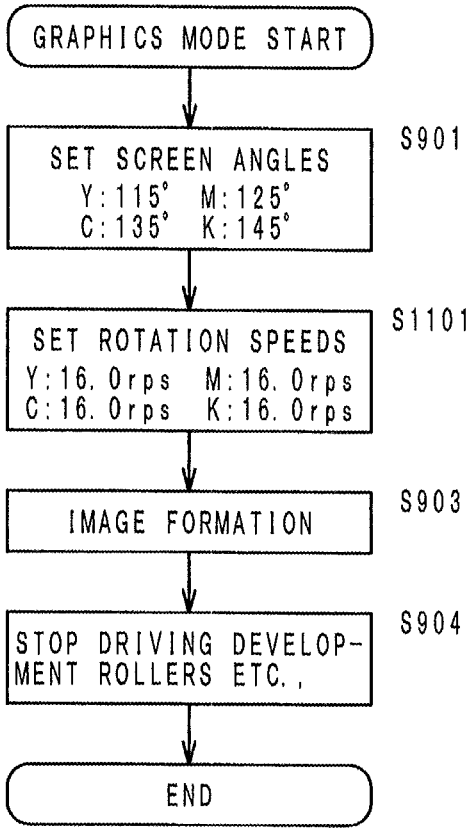
FIG. 11 is a flowchart showing the procedure for a process by a control circuit according to a third embodiment.

The control circuit 81*c* is composed of a processor, main memory, etc., and operates in accordance with the procedure shown in FIG. 11, thereby controlling the printing process in graphics mode.

Regarding Specific Examples of Parameters

The parameters in the present embodiment are the same as those in the first embodiment except for the groove angles θ of the development rollers 78*c* for their respective colors and the setting values n3 for the rotation speeds of the rollers. Therefore, any descriptions of common parameters will be omitted.

Groove angles $\theta_Y$, $\theta_M$, $\theta_C$, and $\theta_K$ of development rollers $\mathbf{78}c_C$, $\mathbf{78}c_M$, $\mathbf{78}c_C$, and $\mathbf{78}c_K$ are as follows.

groove angle $\theta_Y$: 25° groove angle $\theta_M$: 35° groove angle $\theta_C$: 45° groove angle $\theta_K$: 55°

Furthermore, in text mode, the setting value n3 for the rotation speed is 16.0 rps, which is equal among the development rollers 78*a* for their respective colors.

The screen angle and the setting value n3 are prestored for each color in the control circuit 81*c*.

Regarding Printing Procedure

FIG. 11 is a flowchart showing the procedure for the printing process by the control circuit 81*c*. This flowchart differs from the flowchart of FIG. 9 in that step S1101 is included in place of step S902. There is no other difference between the flowcharts. Therefore, steps in FIG. 11 that correspond to those in FIG. 9 are denoted by the same step numbers, and any descriptions thereof will be omitted.

The control circuit 81*c* sets a screen angle for each color in step S901, and thereafter transmits control signals to motors $\mathbf{80}_Y$, $\mathbf{80}_M$, $\mathbf{80}_C$, and $\mathbf{80}_K$ in order to drive development rollers $\mathbf{78}c_Y$, $\mathbf{78}c_M$, $\mathbf{78}c_C$, and $\mathbf{78}c_K$ at 16.0 rps (step S1101).

Subsequently, the control circuit 81*c* performs the processing from S903 onward described in the first embodiment.

In the first embodiment, the groove angle θ of the development roller 78*a* is the same among all colors, and the setting value n3 for the rotation speed of the development roller 78*a* is adjusted so as to vary among the colors, thereby controlling the crossing angle γ to be 90°. On the other hand, in the present embodiment, the rotation speed of the development roller 78*c* is the same among all colors, and the groove angle θ is formed so as to vary among the colors, thereby controlling the crossing angle γ to be 90°. This also allows users to perceive less uneven density upon viewing of a print by the image forming apparatus 1.

In the present embodiment, the crossing angle γ is controlled for each color to be 90°, but it is apparent that the effect of allowing users to perceive less uneven density can be achieved even by setting the groove angle θ of the development roller 78*a* for each color in accordance with the screen angle being set and the rotation speed of the development roller 78*a*, such that the crossing angle γ for that color is closer to 90° than in the case where the development roller 78*a* for another color is assumed to be used.

Note that in the present embodiment also, a similar effect to that achieved in the earlier embodiment can be achieved by setting the rotation speeds of the development rollers 78*c* for all colors such that the crossing angles γ approximate 90°.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

a latent image support;

an optical scanning system configured to form an electrostatic latent image at a predetermined screen angle on a circumferential surface of the latent image support;

a container configured to hold a binary developer;

a development roller disposed so as to face the latent image support and form a development area in between, and configured to carry the binary developer from the container to the development area; and a control circuit configured to rotationally drive the development roller at a predetermined rotation speed during a development process, wherein, the development roller has depression portions and land portions on a circumferential surface, the depression portions and the land portions forming oblique grooves in the surface, and while the development roller is rotationally driven, the control circuit is configured to control the predetermined rotation speed such that a crossing angle approximates 90°, the crossing angle being formed by a screen line in the electrostatic latent image on the circumferential surface of the latent image support and an area where the land portion of the development roller substantially passes over the circumferential surface of the latent image support.

2. The image forming apparatus according to claim 1, wherein, the container is provided in plurality so as to correspond to a plurality of different colors respectively, the development roller is provided in plurality so as to correspond to the containers respectively, the screen angle is set so as to vary among the colors, and for each color, the control circuit controls the rotation speed of the development roller corresponding to that color, such that the crossing angle is closer to 90° for the screen angle being set for the color targeted for control than for a screen angle for another color being assumed as the screen angle for the color targeted for control.

3. An image forming apparatus comprising:

a latent image support;

an optical scanning system configured to form an electrostatic latent image on a circumferential surface of the latent image support, at a first screen angle in a first print mode, and at a second screen angle different from the first screen angle in a second print mode;

a container configured to hold a binary developer;

a development roller disposed so as to face the latent image support and form a development area in between, and configured to carry the binary developer from the container to the development area; and a control circuit configured to rotationally drive the development roller at a first rotation speed during a development process, wherein, the development roller has depression portions and land portions on a circumferential surface, the depression portions and the land portions forming oblique grooves in the surface, and in the second print mode, the control circuit is configured to rotationally drive the development roller at a second rotation speed different from the first rotation speed, such that a crossing angle approximates 90°, the crossing angle being formed by a screen line in the electrostatic latent image on the circumferential surface of the latent image support and an area where the land portion of the development roller substantially passes over the circumferential surface of the latent image support.

4. The image forming apparatus according to claim 3, wherein, in the second print mode, the control circuit is configured to rotationally drive the development roller at the second rotation speed being set such that the crossing angle is closer to 90° for the second screen angle than for the first screen angle being assumed to be set in the second print mode.

5. The image forming apparatus according to claim 1, wherein the control circuit is configured to rotationally drive the development roller such that the crossing angle is approximately 90°.

6. An image forming apparatus comprising:

a latent image support;

an optical scanning system configured to form an electrostatic latent image at a predetermined screen angle on a circumferential surface of the latent image support;

a container configured to hold a binary developer;

a development roller disposed so as to face the latent image support and form a development area in between, and configured to carry the binary developer from the container to the development area; and a control circuit configured to rotationally drive the development roller during a development process, wherein, the development roller has depression portions and land portions on a circumferential surface, the depression portions and the land portions being created by forming grooves in the surface at a predetermined angle of inclination, and the angle of inclination is decided such that a crossing angle approximates 90° while the development roller is rotationally driven, the crossing angle being formed by a screen line in the electrostatic latent image on the circumferential surface of the latent image support and an area where the land portion of the development roller substantially passes over the circumferential surface of the latent image support.

7. The image forming apparatus according to claim 6, wherein, the container is provided in plurality so as to correspond to a plurality of different colors respectively, the development roller is provided in plurality so as to correspond to the containers respectively, and for each color, the angle of inclination is set such that the crossing angle is closer to 90° for the development roller for that color than for the development roller for any other color being assumed to be used.

8. An image forming method for use in an image forming apparatus including a latent image support, an optical scanning system configured to form an electrostatic latent image at a predetermined screen angle on a circumferential surface of the latent image support, a container configured to hold a binary developer, and a development roller that is disposed so as to face the latent image support and form a development area in between, and configured to carry the binary developer from the container to the development area, said method comprising the steps of:

determining a current print mode from among a plurality of print modes;

setting a screen angle for the determined print mode, the screen angle varying among the print modes, and rotationally driving the development roller at a rotation speed for the screen angle being set, the rotation speed varying among screen angles to be set, wherein, the development roller has depression portions and land portions on a circumferential surface, the depression portions and the land portions being created by forming grooves in the surface at a predetermined angle of inclination, and the rotation speed of the development roller is decided for each print mode such that a crossing angle approximates 90°, the crossing angle being formed by a screen line in the electrostatic latent image on the circumferential surface of the latent image support and an area where the land portion of the development roller substantially passes over the circumferential surface of the latent image support.

9. The image forming method according to claim 8, wherein the rotation speed of the development roller is decided such that, in the current print mode for which the rotation speed is set, the crossing angle is closer to 90° for the screen angle being set for that print mode than for a screen angle for another print mode being assumed as the screen angle being set for the current print mode.

* * * * *